United States Patent [19]

Tourneur

[11] Patent Number: 4,561,226

[45] Date of Patent: Dec. 31, 1985

[54] PROCESSES AND DEVICES FOR GREASING THE ENDS OF PRESTRESS REINFORCEMENTS

[75] Inventor: Christian Tourneur, Le Pellerin, France

[73] Assignee: Freyssinet International (STUP), Boulogne Billancourt, France

[21] Appl. No.: 600,453

[22] Filed: Apr. 16, 1984

[30] Foreign Application Priority Data

Apr. 19, 1983 [FR] France ..... 83 06374

[51] Int. Cl.[4] ..... E04C 5/12; E04C 5/16

[52] U.S. Cl. ..... 52/223 L; 52/741; 29/452

[58] Field of Search ..... 184/105 R, 14.1, 105 A, 184/105 B, 105 C; 264/228; 52/223 R, 223 L, 230, 750, 741; 29/452

[56] References Cited

U.S. PATENT DOCUMENTS

| | | | |
|---|---|---|---|
| 2,185,749 | 1/1940 | Kennedy | 264/228 |
| 2,614,660 | 10/1952 | House | 184/14.1 |
| 2,628,518 | 2/1953 | Mitan | 184/14.1 |
| 2,755,657 | 7/1956 | Finsterwalder | 29/452 |
| 3,268,032 | 8/1966 | Dannels | 184/105 R |

FOREIGN PATENT DOCUMENTS

| | | | |
|---|---|---|---|
| 1209949 | 9/1959 | France | 52/230 |
| 482080 | 1/1970 | Switzerland | 52/230 |

OTHER PUBLICATIONS

U.S. Application of Thomarat, Ser. No. 597,095.

*Primary Examiner*—James L. Ridgill, Jr.
*Attorney, Agent, or Firm*—Cushman Darby & Cushman

[57] ABSTRACT

For greasing the end of a reinforcement (2) surrounded by a sheath (3) and retained in a truncated cone shaped ring of jaws (6) coacting with a truncated cone shaped housing (5) formed in an anchorage plate (4), which housing is closed by a cap (11), a longitudinal rectilinear groove (12) is formed in this housing and in this cap is formed an orifice (13) automatically aligned with the groove at the end of fitting of the cap and the inner volume of the assembly is filled with grease through a rectilinear hollow needle (14) passing successively through said orifice and said groove.

8 Claims, 2 Drawing Figures

PROCESSES AND DEVICES FOR GREASING THE ENDS OF PRESTRESS REINFORCEMENTS

Figure 1:
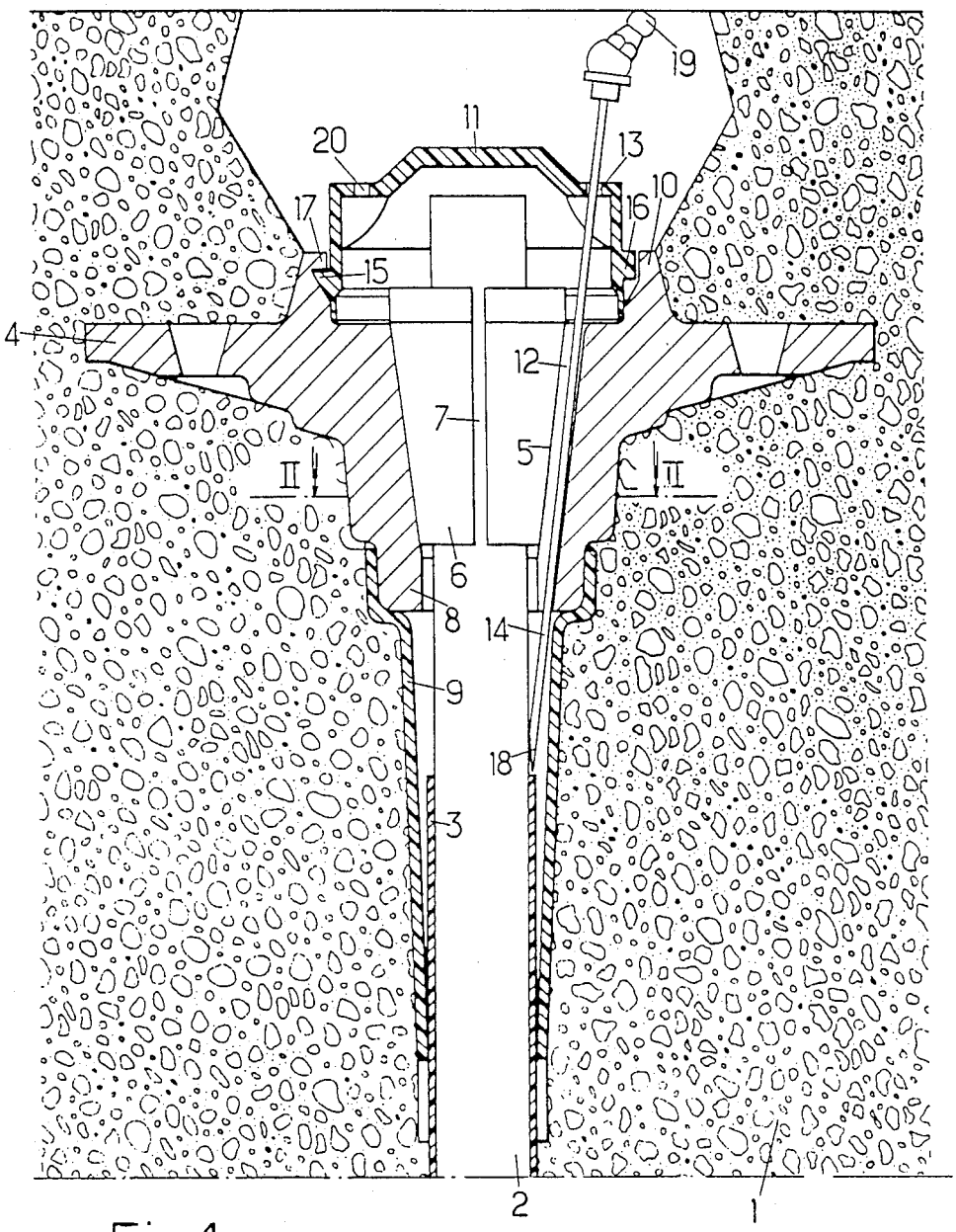

The invention relates to the greasing of the ends of certain reinforcements used, by tensioning thereof, for prestressing concrete elements, said reinforcements being contained in sheaths filled with grease and these sheaths being interrupted a little short of the ends of the reinforcements which they contain.

It relates more particularly to the case where the end to be greased is anchored, by means of a discontinuous truncated cone shaped ring of jaws, in a truncated cone shaped housing, complementary to this ring, formed in a rigid plate bearing on the concrete element to be prestressed.

The larger diameter end of said housing, namely the one which opens on that side of the plate opposite the concrete element, forms the center of a cup itself sealed to the grease by a cap whereas the other end of the housing is connected with relative grease sealing to the corresponding sheath end, more especially by means of a plastic material funnel.

In the known embodiments of these assemblies, for completing the filling with grease of the volume formed by the intercommunicating spaces contained inside the cap, the cup, the truncated cone shaped housing, the connecting funnel or similar and the sheath, this grease is injected into said volume through an orifice formed in the cap.

This process presents several drawbacks and in particular the following.

In order that the grease may penetrate fairly deeply into the volume to be filled, namely up to the level of the sheath, a relatively high pressure must be developed on this grease during the injection thereof.

This high pressure requires the use of mechanically resistant and very expensive caps as well as the formation of a tight seal between this cap and the facing cup.

Moreover, even for very high values of the injection pressure, the filling with grease often leaves much to be desired, since the grease introduced into the small gaps to be filled itself forms an obstacle to the escape, through these gaps, of air bubbles which this grease is intended to replace.

The aim of the invention is especially to remedy these disadvantages by ensuring in a very simple way complete filling with grease without it being necessary to give a high value to the injection pressure.

To this end, in accordance with the invention, there is provided, on the one hand, in the truncated cone shaped internal face of the housing of the jaws, a rectilinear groove whose mean line is parallel to a generatrix of the truncated cone defining this housing and, on the other hand, in the cap an orifice capable of being aligned in the extension of the groove during mounting of said cap on the cup.

Thus, it is possible to ensure the desired filling with grease through a hollow rectilinear needle passing successively through this orifice and the passage defined by said groove and the facing jaw.

To achieve such filling, said needle is first of all introduced to the bottom of these two aligned housings so that its end emerges in the immediate vicinity of the end of the sheath, then the grease is introduced through this needle until it flows back out of the gap, whereafter the needle is withdrawn while continuing to inject grease until the end of the withdrawal.

In preferred embodiments, recourse is further had to one and/or the other of the following arrangements:

complementary means are provided on the cap and on the cup for automatically placing the orifice of this cap in the extension of the groove after it is fitted on the cup, the cap and the cup are adapted so as to allow the bayonet fitting of the first on the second and the complementary means according to the preceding paragraph comprise respectively on said cap and on said cup two complementary bearing surfaces adapted to abut one against the other at the end of the angular travel of the cap which terminates said bayonet fitting, in accordance with French Pat. No. 83 05612, the cap is made from a plastic material, the sheathed and greased reinforcement is formed by a single strand.

The invention comprises, apart from these main arrangements, certain other arrangements which are preferably used at the same time and which will be more explicitly discussed hereafter.

In what follows, a preferred embodiment of the invention will be described with reference to the accompanying drawings in a way which is of course in no ways limitative.

Figure 2:
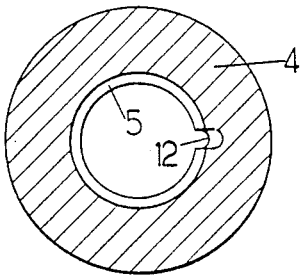

FIG. 1, of these drawings, shows in axial section the end of a sheathed and greased prestressed cable as well as its anchoring device and the means for greasing this device constructed in accordance with the invention; and FIG. 2 is a cross section of FIG. 1 through II—II.

The reinforcement considered, intended for prestressing a concrete work or element 1 by being tensioned between its two ends, is preferably formed by a strand 2 itself formed of wires wound about a central wire having a slightly larger diameter.

In a way known per se, this strand is itself surrounded by a sheath 3 made from a plastic material, for example from polyethylene, and the volumes between the sheath and the wires forming the strand are filled with grease.

Such sheathing and such greasing have the double advantage of making possible the relative sliding between the reinforcement and the sheath, after concrete has been poured about this latter, which facilitates the tensioning of said reinforcement and protecting this reinforcement from corrosion, in particular from dampness.

One of the ends of the strand is retained by an anchoring device which comprises a metal plate 4, made more especially from cast iron, thickened at its center and pierced at its center with a truncated cone shaped housing 5.

This housing 5 is adapted for jointingly receiving the reinforcement end considered surrounded by a set of three jaws 6 forming a ring split longitudinally along three slits 7: each of these jaws extends substantially over 120° about the axis common to the strand 2 and to housing 5 and has a cylindrical inner face adapted to match the strand and an external face having a truncated cone shape complementary to the housing and bearing there against.

The edge of the smaller diameter mouth of the truncated cone shaped housing 5, or more precisely that of a cylindrical collar 8 axially extending this mouth, is connected relatively sealingly to the end of sheath 3—which sheath is interrupted short of the end of reinforcement 2 so that jaws 8 can grip on this reinforcement—by means of an appropriate funnel 9 made from a plastic material whose cylindrical end is force fitted on said collar.

The edge of the other mouth of housing 5, namely the larger diameter one, has the shape of a cup of revolution 10 sealingly closed by cap 11.

Furthermore, in accordance with the invention, there is formed:

in the internal truncated cone shaped face of housing 5 a longitudinal rectilinear groove 12 extending parallel to a generatrix of this face, and in the bottom of cap 11 an orifice 13 able to be aligned with said groove 12 during the fitting of cap 11 onto cup 10.

The cross sections of the two housings 12 and 13 are such that they may both let pass therethrough, preferably with clearance, a hollow rectilinear needle 14 for filling the device with grease, as will be more fully described further on.

The external diameter of this needle is generally between 1.5 and 3 mm so that the width of each of the housings 12 and 13 is advantageously between 2 and 5 mm.

The profile of groove 12 has preferably the shape of a U.

Contrary to what might be throught, the presence of this groove in the internal face of housing 5 in no ways disturbs the positioning and the maintenance in position of jaws 6, and the angular position of these jaws with respect to said groove about the axis of the device is itself quite immaterial.

Thus, one of the slits 7 separating two adjacent jaws may be facing groove 12 just as this latter may be covered over the whole of its width by the same jaw: in this latter case, if it is considered that the angular width of groove 12, seen from the axis of the device, is of the order of 10°, this width only represents about a tenth of that of the portion, of the internal truncated cone shaped face of housing 5, against which the jaw considered comes to bear.

Cup 10 and cap 11 are preferably formed so that the second may be fitted onto the first one automatically by aligning orifice 13 with groove 12.

To this end, mutual angular positioning means are provided respectively on both these elements 10 and 11.

According to a particularly advantageous embodiment, said elements are formed in the way described in the above French patent.

In other words, the two elements in question are arranged so that their mutual assembly is achieved by a bayonet movement, guided by studs 15, 16 provided on the cap with interrupted circular ribs 17 provided on the cup, the end of the angular travel which forms the second and last phase of the bayonet movement being determined by stud 16 coming into angular abutment against one of ribs 17.

Such being the case, for filling the inner volume of the above described assembly with grease, the following is the procedure to follow.

After fitting the cap on the cup, the needle 14 is pushed home through successively orifice 13 and groove 12: the end 18 of this needle then emerges in the immediate vicinity of the end of sheath 3, inside the funnel 9.

By means of a grease nipple 19 fitted permanently or not to the outer end of needle 14 grease is injected into this latter, which deposits it directly in the deepest zones of the volume to be filled.

The air driven out of these zones then flows back towards the outside through all the freed ducts, more especially through slits 7 and through that portion of groove 12 which is not occupied by the needle 14 itself.

Discharge of this air from cap 11 is preferably achieved through a second orifice 20 formed in the bottom of this cap and then open, but this discharge could also take place through the orifice 13 itself, whose section is then greater than that of needle 14.

Although this needle may be disengaged gradually during filling of the assembly with grease, it is preferable to wait until the grease begins to flow back out of the cap before beginning this disengagement.

This procedure is then performed fairly slowly so that the volume progressively freed by the needle full of grease is immediately filled with the grease which the needle continues to supply.

After total disengagement of this latter from the cap, orifice 13 is closed and orifice 20 as well if this latter is also provided.

Such closure may be obtained in any desirable way be means of plugs independent or not of cap 11.

Filling of the device with grease is then complete.

Following which and whatever the embodiment adopted, means are finally provided for filling with grease the device for anchoring a prestress reinforcement, the construction and the operation of said means being clear enough from the foregoing.

These means present a number of advantages with respect to those known heretofore.

In addition to the above mentioned complete filling, another important advantage resides in the relatively low value required for the pressure for injecting the grease: in fact, the air volumes driven out during filling may be freely discharged, this discharge not being hindered by the volumes of grease being injected. It should be further noted, that this pressure itself relatively low, is only applied at the level of the cap, by the air and/or the grease driven out from the end of the needle, after a reduction due to pressure losses imposed on this air and/or on this grease when they pass through discharge ducts of reduced section: therefore, it is possible to adopt for the cap an article having a relatively low mechanical strength such as one of those made from a plastic material described in the above French patent, which have both the advantage of a modest price, that of easy use, thus making it unnecessary to provide independent seals, and that of a very long useful life.

As is evident, and as it follows moreover already from what has gone before, the invention is in no ways limited to those of its modes of application and embodiments which have been more especially considered; it embraces, on the contrary, all variations thereof.

I claim:

1. An assembly at the end of a prestressed concrete member for greasing the end of a reinforcement rod comprising:

a greased sheath;

a reinforcement rod disposed in said greased sheath so that a portion of said reinforcement rod extends beyond said sheath;

an anchor plate having a top side and a bottom side, said anchor plate defining a conical shaped central opening with an interior surface extending between and opening at said top and bottom sides, and a groove extending the length of said interior surface, wherein said groove terminates before said sheath;

a set of jaws, disposed in said conical shaped central opening of said anchor plate, gripping said portion of said reinforcement rod; and a cap fitted over said opening on said top side, said cap having a hole passing therethrough alignable with said groove.

2. The assembly of claim 1 further comprising means for aligning said hole with said groove when said cap is secured over said opening on said top side.

3. The assembly of claim 1 further comprising bayonet connection means for securing said cap to said anchor plate.

4. The assembly of claim 1 wherein said cap is plastic.

5. The assembly of claim 1 wherein said sheath is a single piece.

6. The assembly of claim 1 wherein said reinforcement rod is a single piece.

7. The assembly of claim 1 further comprising a hollow needle with a first and a second end, said first end of said needle adapted to pass through said hole and into said groove, said second end of said needle having a grease nipple.

8. A process for greasing the end of a reinforcement rod of an assembly of a prestressed concrete member, said assembly having a greased sheath, a reinforcement rod disposed in said greased sheath so that a portion of said reinforcement rod extends beyond said sheath, an anchor plate having a top side and a bottom side, said anchor plate defining a conical shaped central opening with an interior surface extending between and opening at said top and bottom sides, and a groove extending the length of said interior surface wherein said groove terminates before said sheath, a set of jaws disposed in said conical shaped central opening of said anchor plate and gripping said portion of said reinforcement rod, and a cap fitted over said opening on said top side, said cap having a hole passing therethrough alignable with said groove, said process comprising the steps of:

inserting a hollow needle with a first and second end, through said hole and into said groove so that said first end of said needle is between said jaws and said sheath;

injecting grease through said needle until the grease flows back out of said cap; and removing said needle while continuing to inject grease until said needle is withdrawn from said cap.

* * * * *